US008185350B2

(12) United States Patent
Deriso, Jr. et al.

(10) Patent No.: US 8,185,350 B2
(45) Date of Patent: May 22, 2012

(54) SYSTEMS AND METHODS FOR OPERATIONAL VERIFICATION OF A MISSILE APPROACH WARNING SYSTEM

(75) Inventors: Sam C Deriso, Jr., West Melbourne, FL (US); Jeff Koehler, Melbourne, FL (US)

(73) Assignee: DRS Sustainment Systems, Inc., St. Louis, MO (US)

( * ) Notice: Subject to any disclaimer, the term of this patent is extended or adjusted under 35 U.S.C. 154(b) by 350 days.

(21) Appl. No.: 11/876,995

(22) Filed: Oct. 23, 2007

(65) Prior Publication Data

US 2009/0254307 A1 Oct. 8, 2009

(51) Int. Cl.

| | |
|---|---|
| ***G06F 11/30*** | (2006.01) |
| ***G21C 17/00*** | (2006.01) |
| ***G02B 6/26*** | (2006.01) |
| ***G02B 6/42*** | (2006.01) |

(52) U.S. Cl. ..... 702/182; 244/1 N; 250/504 R; 385/15

(58) Field of Classification Search ..... 702/182; 250/504 R; 244/1 N; 385/15

See application file for complete search history.

(56) References Cited

U.S. PATENT DOCUMENTS

| | | | | |
|---|---|---|---|---|
| 3,693,401 | A * | 9/1972 | Purt et al. | 73/1.05 |
| 3,964,695 | A * | 6/1976 | Harris | 244/3.16 |
| 4,173,777 | A * | 11/1979 | Schmit et al. | 362/253 |
| 4,177,667 | A * | 12/1979 | Rolf et al. | 73/1.06 |
| 5,693,951 | A * | 12/1997 | Strong, III | 250/504 R |
| 6,423,962 | B1 * | 7/2002 | Pepper | 250/222.1 |
| 6,964,198 | B2 * | 11/2005 | Eisenhower, Jr. | 73/717 |
| 2005/0155408 | A1 * | 7/2005 | Weyl et al. | 73/23.31 |
| 2005/0248299 | A1 * | 11/2005 | Chemel et al. | 315/312 |

FOREIGN PATENT DOCUMENTS

| | | | |
|---|---|---|---|
| GB | 2400644 | A * | 10/2004 |
| WO | WO 9500813 | A1 * | 1/1995 |

* cited by examiner

*Primary Examiner* — Janet Suglo

(74) *Attorney, Agent, or Firm* — Kilpatrick Townsend & Stockton LLP

(57) ABSTRACT

A coupler that generates and emits a simulated missile signature for assessing the operational capability of a missile approach warning system. The coupler may be directly attached to the system by an adapter. Couplers may be used in multiplicity, simultaneously or sequentially. The simulated signature may be digitally stored, as may be the results of the assessment. Simulated signatures may also be generated from freeform. The coupler also performs sensitivity testing.

36 Claims, 6 Drawing Sheets

SYSTEMS AND METHODS FOR OPERATIONAL VERIFICATION OF A MISSILE APPROACH WARNING SYSTEM

CROSS REFERENCE TO RELATED APPLICATIONS

This application claims benefit of U.S. Provisional Patent Application Ser. No. 60/862,554, filed Oct. 23, 2006. The entire disclosure of the above document is herein incorporated by reference.

BACKGROUND

1. Field of the Invention

This invention relates to an operational verification system for testing the operational capability of a missile approach warning system, such as is deployed on military aircraft, and methods for using that system. In particular this invention relates to an active coupler that creates and emits a test signal and which can be connected directly to electro-optical sensors deployed on aircraft to detect electro-optical signals emitted from missiles.

2. Description of the Related Art

Today's armed forces face increasing worldwide proliferation of missiles, including advanced infrared (IR) guided missiles, surface-to-air missiles, and air-to-air missiles. Political entities that once were confined to arms used in hand-to-hand combat have developed surface-to-air missiles. Missiles often attack without being visually observed, and can strike in a matter of seconds. Reliance upon and installation of missile warning systems is therefore increasing. Such systems are useful in multiple types of aircraft, and even in tanks to detect anti-tank missiles.

As a missile is essentially a variation on a rocket, each missile, as it travels towards its target, generates a plume, or exhaust trail, unique to that missile. Accurate plume analysis permits accurate identification of missiles and engagement in appropriate countermeasures. In analyzing the plume, the sensor counts photons in a sub-spectrum of interest of the ultraviolet or near-infrared spectrum. The sensor integrates the photon counts over small time intervals, which results in an optical power versus time signature, in watts over time, for each missile. This signature is compared to templates and the presence or absence of a match determined. The sensors reject man-made and natural clutter sources, and can detect missile plumes from a substantial distance.

The AAR-47 and 57 Missile Warning System/Missile Avoidance Warning System ("MAWS"), and other missile warning systems known in the art, are frequently used optical-based sensor systems deployed on fixed and rotary winged aircraft to detect short range missile launches. They consist of multiple electro-optical sensors, which read the signature and convey that data to an internal electronics control unit. The control unit processes the data, categorizes the missile, provides direction-of-arrival and elevation information, provides a warning, and directs countermeasures such as flares or jamming.

Such missile warning systems must be accurate; both early detection and a low rate of false alarms are required to protect pilots and their cargo without the stress of false alarms. The sensors must be very sensitive to the presence of plumes at a substantial distance, particularly when the aircraft is at a high altitude. Unfortunately, these missile warning systems rely on electronic and optical components that deteriorate with age and exposure to extreme environmental conditions such as those present at high altitudes and combat conditions (e.g., sand and salt water, in the case of aircraft launched from aircraft carriers). Sensitivity and accuracy of signature matching must be tested routinely in order to maintain optimal sensor performance. In addition, as new missiles with previously unknown signatures are developed, the sensors' accuracy in detecting those new signatures must be tested and evaluated.

One way of testing missile warning systems is by providing them with a signal in the same wavelength as a missile signature and evaluating the system's response. Such missile signature testing emits a signal in the appropriate wavelength, varying intensity (watts) and duration (time) of light presented to the sensor within the duration of the signal and between signals. This type of testing can be performed in the UV and infrared parts of the spectrum. Such a signal may be called a "waveform." The sensor's response to the simulated signature is then analyzed for its ability to detect the waveform and direct appropriate countermeasures. More details about current waveform emission and sensor testing will be set forth below as its disadvantages are discussed in turn.

Current testing systems present many problems. One concern is the level of extraneous light in many test situations, which weakens the test's accuracy. This is because the sensor counts both the photons in the environment, which are present in an uncontrolled and inconsistent amount, and the photons emitted by the tester. Welding, street lamps, and other sources can create environmental light in the spectrum generated by missile plumes and detected by missile warning systems. If light from these sources is detected by the sensor during a test, it will make the test less accurate because it is no longer based solely on the tester's calibrated emission. It is therefore desirable for a tester to be coupled to the sensor in a manner that excludes environmental light input and provides an isolated test environment. Herein, the term "coupler" refers to any mechanical enclosure that provides an isolated testing environment similar to that of a laboratory environment by preventing any undesired environmental effects.

Some current testers have a coupler designed to block such ambient light. Such couplers are separate entities from the tester itself. They are generally tube-shaped and are held in place by the technician while he/she is simultaneously operating the sensor. This handheld manner of use introduces a great deal of human error, as the technician may easily inadvertently move the coupler, especially when tired or in harsh conditions as is probably the case in the context of an armed conflict or extended training exercise. Such movement may expose the sensor to ambient light while the tester is emitting its signal, thereby destroying the accuracy of that test and any grounds for comparison with other tests. In addition, the technician cannot walk away from the aircraft to attend to other tasks in testing the sensor, because the technician must hold the coupler.

Current couplers also do not allow for accurate or repeatable positioning of the emitter and coupler. This may result in varying input angles that in turn adversely affect sensitivity testing data. That is, because the light shields of current testers are handheld and subject to inconsistent placement, the tester's signal is inconsistent in its intensity and directional approach relative to the sensor. Such inconsistency is unacceptable, as it is desirable to test the accuracy of a sensor's review of intensity and directional approach. It therefore remains desirable for a sensor to include a self-attaching coupler that completely and consistently blocks ambient light without relying on human positioning, and that standardizes the direction and intensity of the tester's signal.

Substantively, current tests are also far from comprehensive. Standard signature tests, called "Built-In-Tests"

("BITs"), are performed by a relatively small emitter that is part of the sensor itself as opposed to any exterior, more complex tester. BITs simply test whether the sensor does or does not detect any signal at all. Because the BITs do not generate a simulated signature or waveform, but rather a very simple "on/off" emission, they do not evaluate the sensor's accuracy in discerning between signatures. As such, BITs do not test a sensor's accuracy for different missile arsenals. This is particularly important as the field of missile technology advances and different countries generate different missiles. BITs also do not test the sensor's ability to accurately read the missile's angle of approach. Neither do they test the sensor's sensitivity, which is important as it reflects the sensor's ability to detect a plume at a substantial distance. BIT testing also does not test all quadrants of the sensor's field of view, leaving room for undetected inaccuracy. It is therefore desirable to expand standard sensor testing to test signature identification, all sensor quadrants, sensor sensitivity, and angle of approach.

A more sophisticated current test is called Flight Line Test Set, or FLTS. FLTS uses low pressure mercury vapor lamps to generate a non-signature waveform: that is, the signal simply vacillates between low and high intensity, in the form of a light simply blinking on and off, rather than generating a signal that resembles an actual signature in its complexity. The sensor being tested thus receives not a simulation of a missile signature, but a relatively simpler "on-off" signal with no relation to any missile. This non-signature waveform does not adequately test the sensor's ability to read a complex signature. It also does not test the system's capability to detect and correctly recognize a specific missile threat, or to discern between different missiles. While the manufacturer of FLTS has limited FLTS to simple non-signature waveforms in the belief that actual signature testing is not necessary, such testing is believed important as the field of missile technology advances and different countries generate different missile arsenals.

One current improvement on FLTS, the Baringa, has a more accurate sensitivity test and can produce actual signatures. This system, too, is limited in its ability to simulate actual signatures, as its signals do not accurately represent missiles approaching from different directions. The generation of signatures representing approaches from different directions is performed by simply walking around the aircraft while transmitting a missile signature. This method is very inaccurate in representing a missile approaching from a specific direction. Sensors should be able to discern the direction from which a missile approaches, in order to provide the most useful information in the context of evasive or countermeasures (i.e., in which direction the plane should fly to avoid the missile, or in which direction antimissile projectiles should be launched).

It is therefore desirable for waveform testing to generate a simulated signature that can test the system's ability to discern between missiles and the direction from which those missiles approach. It is especially desirable for a tester to be equipped with software to produce signature simulations in accordance with set parameters, such as the actual signatures of missiles in an arsenal an aircraft may actually encounter in an upcoming mission. In this way, a fleet of planes or other vehicles headed for a conflict or warzone may be tested for their ability to detect the missiles prevalently used by enemy combatants in that area. In addition, it is desirable for these parameters to be reprogrammable, to adapt the tests to changing arsenals. In this way, planes or vehicles that move among or between conflicts or warzones over time may be tested for their ability to detect the most relevant arsenal.

Current testers also do not provide any means for storing actual or simulated signature parameters, for reference in evaluating past tests or in creating and customizing future tests. Current testers cannot accomplish such storage of any information about the performed test. Testers with the capacity to internally generate waveforms and store test parameters and results are thus both self-sufficient and fully customizable. The customization according to stored parameters permits development and improvement of a threat library with signatures that simulate the plumes of the arsenal the aircraft may likely encounter. Another desirable use of memory is in the event of a sensor failure, to retroactively review what signatures were used in past tests of that sensor that permitted its failure to occur undetected.

One current tester, the Baringa, permits signature storage and generation of signatures according to stored parameters, but requires access to and exchange of information with a laboratory. Given the often remote locations in which aircraft sensors are tested, including aircraft carriers and deployments, this requirement of access to a laboratory hampers the ability to store signatures often when it is needed most, in battle or deployment. In addition, heightened security in those contexts often prohibits the exchange of data between a laboratory and the tester. It therefore remains desirable for a tester to be able to store signature data without requiring an external laboratory, in a simplified and portable theater.

Regarding portability, it is particularly desirable for the generator and emitter to constitute one self-contained entity capable of enduring rugged conditions. It is also desirable that the tester not require calibration upon delivery to a test site. Portability is also enhanced by having a replaceable battery power source.

Current testers only provide a very poor level of sensitivity testing. This is due in part to the inaccuracy inherent in the use of the handheld coupler, explained above, which lets in ambient light that the sensor may detect instead of or in addition to the faint sensitivity test signal. It is therefore desirable for a missile testing system to accurately test sensitivity. Sensors with good sensitivity are especially important as missiles become faster and it becomes more necessary to detect the missiles from a further distance in order to respond defensively.

Another disadvantage of FLTS is that each tester must be placed around three meters from the aircraft, with one operator per tester. Testing from a further distance requires another, separate set of long range testers; these multiple tester sets are expensive and tedious to transport and set up. It is therefore desirable for a missile tester to be able to test from any distance.

FLTS emits its signal using low pressure mercury vapor lamps without a fluorescent coating. Such lamps present many problems. They use a great deal of power, which shortens the life of any associated battery power source. They are extremely heavy, which decreases the tester's portability and manipulability. In addition, such lamps require a high voltage, which creates a great deal of inefficiency in the form of heat when the lamps are turned on. Such lamps also waste operator time in that they require at least five minutes to "warm up" and stabilize before they can be used.

More specifically, mercury vapor lamps are not well suited to the specific task at hand of creating a variety of test signatures. It is not easy to change the intensity of a mercury vapor lamp's output, which stymies the instant purpose of creating different signatures based on varying intensity. These bulbs must be outfitted with bandpass filtering in order to produce definite wavelengths. This is problematic, as bandpass filtering does not in fact completely filter all undesired wavelengths, but simply attenuates those at the margins of desirability. Thus, testing with bulbs relying on bandpass filtering is not completely accurate. It is therefore desirable to use a sensor testing system that generates certain wavelengths without reliance upon bandpass filtering.

Another problem inherent in using mercury vapor lamps is that, in order to achieve different wavelengths, different specially designed bulbs must be built, purchased, and interchanged. This is costly, tedious, inefficient, and requires the risky manipulation of fragile tester components. It is therefore desirable for a sensor to be able to generate different wavelengths without bulb replacement.

The output between different sets of mercury vapor lamps is quite variable, as much as 30% between units; this detracts from the uniformity and ease of comparability between test results. It is desirable for a simulating tester to utilize bulbs other than low pressure mercury vapor lamps, in order to increase uniformity across testers.

An additional difficulty with current testers is that their filters are external and thereby prone to being damaged. Testers require filters in order to filter the signal from the strength at which it is generated to the strength appropriate for processing by the sensor. Some tests are unfiltered, while others are not; this depends in part on the tester's distance from the aircraft. Filters on current testers are external to the tester, such that they are easily scratched or shattered. The filter's external position is particularly risky due to the often harsh environments in which it is employed; aircraft are often in harsh environments wherein the filter may be damaged by sand, salt water, ice, or any other windblown particulate. In switching between filtered and unfiltered tests, current operators must manually remove the filter from the tester and stow it; this also introduces risk of damage to or loss of the filter. It is therefore desirable to have a filter internal to the tester which can be selectively engaged without separation from the tester.

SUMMARY

In summary, current missile sensor testing devices present numerous problems. Many only test sensors' ability to detect any signal at all, by emitting a very simple waveform that is much less complex than a simulated missile signature. If a sensor picks up any signal, it will "pass" the test. Essentially, the test only discerns whether the sensor is functioning at a bare-bones level, with no ability to discern the level of functioning and take measures to improve that functioning. This is not believed to be a sufficiently stringent standard test, as it is believed to be necessary to test the sensor's ability to discern between actual missiles in order to take appropriate evasive action.

Because of these and other problems in the art, disclosed herein are systems and methods for testing missile sensors' ability to detect and correctly identify simulated missile signatures and the direction from which they approach. Among other things, disclosed herein is a system for testing a missile warning system, comprising a coupler comprising a signal generator, a light emitter, an internal filter, and an external switch for the filter; digital storage functionally linked to the signal generator, wherein the digital storage stores information including a plurality of signatures; and a computer capable of permitting a user to select a signature from the plurality; wherein the signal generator generates the selected signature and causes it to be emitted by the light emitter. In an embodiment, the light emitter is an LED bulb in the infrared spectrum. The light emitter may also be an LED bulb in the ultraviolet spectrum.

In an embodiment of the system, the missile warning system comprises quadrants, and the signature emitted by the light emitter stimulates more than one of the quadrants.

In an embodiment, the digital storage is FLASH memory. The digital storage may be internal and/or external to the coupler.

In an embodiment, the information comprises results of a test of a sensor by the coupler. Additionally or alternatively, the information comprises results of a test, the results identified by sensor or by aircraft.

In an embodiment, the selected signature is derived from freeform.

In an embodiment of the system, the system further comprises an adapter, comprising a cylinder designed to interface with an aircraft sensor to be tested, a pad, and a compressor; wherein the adapter affixes the coupler to the sensor when the cylinder surroundingly interfaces with the sensor and when the pad is compressed.

In an embodiment of the system, the coupler is handheld. In an embodiment, the signature is converted to a linear analog current drive for emission.

Also disclosed herein, among other things, is a system for testing a multisensor missile warning system, comprising a first coupler comprising a first signal generator and a first light emitter; a second coupler comprising a second signal generator and a second light emitter; digital storage functionally linked to the first signal generator and the second signal generator, wherein the digital storage stores information including a plurality of signatures; and a computer, wherein the computer is capable of permitting a user to select a signature from the plurality, and of directing the first signal generator to generate the signature and cause the first light emitter to emit the signature, and of directing the second signal generator to generate the signature and cause the second light emitter to emit the signature; wherein the first coupler and the second coupler are in digital communication; and wherein the signal generator generates the selected signature and causes it to be emitted by the light emitter.

In an embodiment of the system, the computer is a component of the first coupler.

In an embodiment, the signature is converted to a linear analog current drive for emission. The emission by the first light emitter and the emission by the second light emitter may be simultaneous.

In an embodiment of the system, the first coupler is affixed to the first sensor by a first adapter; the second coupler is affixed to the second sensor by a second adapter; wherein the first adapter and the second adapter each comprise a cylinder designed to interface with the first sensor or the second sensor, respectively, a pad, and a compressor; wherein the first adapter affixes the first coupler to the first sensor when the cylinder surroundingly interfaces with the first sensor and when the pad is compressed; and wherein the second adapter affixes the second coupler to the second sensor when the cylinder surroundingly interfaces with the second sensor and when the pad is compressed.

In an embodiment, the first coupler and the second coupler are handheld.

Also disclosed herein, among other things, is a method for testing a missile warning system, comprising having a sensor for light in the spectrum of a missile plume; providing a coupler comprising a signal generator and a light emitter; providing digital storage functionally linked to the signal generator, wherein the digital storage stores information including a plurality of signatures; selecting a signature from the plurality using a computer; generating the signature from the signal generator; emitting the signature from the light emitter; analyzing a response of the sensor to the signature; and storing the response in the digital storage.

In an embodiment of the method, the method further comprises a step of converting the signature to a linear analog current drive for emission. Alternatively or additionally, the method further comprises a step of affixing the coupler to the missile warning system by an adapter.

In an embodiment of the method, the missile warning system comprises quadrants, and wherein the step of emitting stimulates more than one of the quadrants.

In an embodiment, the information comprises results of a test of a sensor by the coupler In an embodiment of the method, the sensor is a first sensor, and wherein the step of having further comprises having a second sensor; wherein the coupler is a first coupler; further comprising a step of providing a second coupler in digital communication with the first coupler; and wherein the steps of generating and emitting are performed by both the first coupler and the second coupler.

In a further embodiment, the method further comprises a step of affixing the first coupler to a first sensor by a first adapter, and the second coupler to a second sensor by a second adapter.

DESCRIPTION OF PREFERRED EMBODIMENTS

Disclosed herein, among other things, is a testing system, or coupler, which may be used for testing of military sensors for detecting missiles. Specifically, there are described active couplers including LED bulbs, driven by software, that can be directly attached to multiple sensors to isolate the sensors for testing based on coupler-emitter output in the substantial absence of external ambient noise signals.

Figure 1:
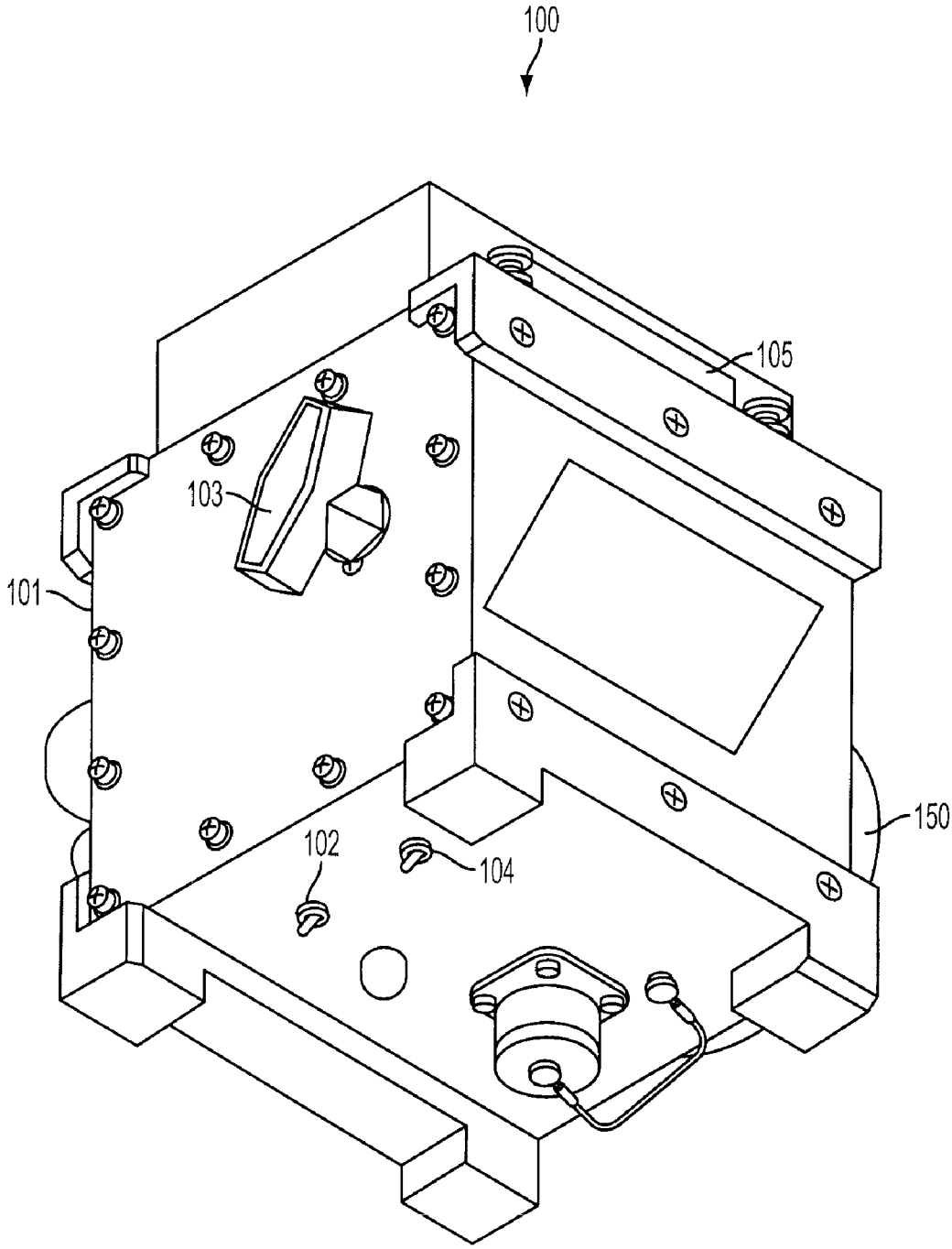
FIG. 1 shows an embodiment of a coupler.

An embodiment of the coupler (100) is shown in FIG. 1. In an embodiment, the coupler is contained within a rugged transit container or shell (101). The coupler (100) derives its power from replaceable batteries, or from a power and communication cable, which is accessed using an externally mounted on/off switch (103). These batteries may last as long as eight hours. The battery pack (105) may be external to the shell (101). The batteries may be of any type; in an embodiment, they are standard AA size and voltage. The shell (101) and batteries contribute to the coupler's (100) portability.

The coupler may emit its signal upon switching a test switch (104). The signal may be emitted by UV embedded emitters and/or an infrared laser. The UV emitters may comprise one or more solid-state component LED bulbs. In an embodiment, such a bulb may be a TO-39 UVC bulb. While the embodiments herein utilize LED bulbs, any other equivalent emitter known in the art or discovered may be utilized. Such bulbs solve the problems set forth above associated with mercury vapor lamps. More specifically, they have low power and low voltage requirements. They are much lighter, totaling less than five pounds even when coupled with a battery pack. LED bulbs do not require any warm-up time, and are replaceable.

Perhaps most importantly for the instant purposes of the LED bulbs, they may be easily be modulated to generate approximately 1,000 intensity levels. These intensity levels, in an embodiment, are generated by linear current modulation. They may be calibrated to any desired wavelength, obviating any need for bandpass filtering. In an embodiment, selections for output power range from one to 100, in 10% increments. In alternate embodiments, other increments are available, including 0.5%, 1%, 2%, and 5% increments.

Varied levels of output power allow the operator to flood the sensor with different levels of energy from the LED in a signal, or optical waveform, to the sensor. This signal provides signature and sensitivity testing beyond the scope of current BIT testing. That is, the intensity of the LED is readily altered, which permits creation of different simulated signatures (by varying the intensity and the time for which the light is produced) that are ultimately targeted at the sensor. The ease of LED intensity alteration also permits acute sensitivity testing by facilitating signals of very low intensity.

In an embodiment, the bulbs may be equipped with UV filters, which may be of neutral density. Many LED bulbs may be installed to encompass different areas of the UV spectrum. In an embodiment, at least one bulb would emit light with a bandwidth of 10-12 nm.

In an embodiment, the bulb or bulb array has multiple channels, which in a further embodiment may number eight. In an embodiment, the coupler operator may select which channel should operate. These channels are paired off to each of the coupler's four quadrants, and each pair is oriented at an angle, such that the channels permit simulation of different angles of approach. In an embodiment, channels paired within a quadrant may be positioned at 22.5 degrees and 45 degrees; alternate embodiments may utilize any position relevant for sensor testing. Such control and coordination of multiple quadrant couplers provides simultaneous threat stimulus for multiple quadrant angle of arrival testing, which current couplers do not test.

In a further embodiment, the coupler comprises multiple LEDs (which, in a further embodiment, number at least three) representing wavelengths for specific use in testing sensitivity in the spectrums in which the sensor becomes less accurate. This area, known as the degradation band edge, is particularly important to test, as it is usually the first area to fail.

The generated signal is a linear analog current drive, rather than reliant on pulsewidth modulation. In an embodiment, an embedded microcontroller or microprocessor converts the digitally stored signature characteristics to a LED bulb drive signal with the use of digital to analog converters and voltage to current converter circuitry. This digitally created linear signal is efficient in producing an LED bulb drive current that can respond to variations in LED bulb output power due to temperature changes, thus producing a calibrated output signal.

In an embodiment, the signal generated as disclosed herein may be used to test within a wide range of distances. In an embodiment, this range may be 0.15 to 15 meters from the sensor. This meets the goal of not being restricted to testing only from around 3 meters from the tester. The systems and methods disclosed herein may be used at any range; the disclosure contemplates open range testing, which in an embodiment may take place at around 6 km from the sensor.

Alternatively, an operator may create an original signature. In an embodiment, such an original signature may be created "freeform" by using a stylus on a touch-sensitive screen to draw a signature on a graph with axes of time and intensity; the tester, operatively connected to the screen, could then generate that signature. This achieves the stated goal of onsite secure signal generation.

A coupler embodiment called an "active coupler" stores and recalls test information, such as signal parameters and signatures; processes and generates the required test signal; and transmits it to the system under test, all without requiring any external storage or signal source. The active coupler generates the signal itself rather than simply relaying it from an external source. The active coupler may generate the signature according to parameters stored in a bank of actual missile signatures and standard test waveforms, which, as will be detailed below, may be stored by the active coupler itself or by an external storage site. In an embodiment, the signature may be displayed on a screen functionally connected to the tester, either wired or wirelessly.

The active coupler's storage may utilize FLASH memory or any equivalents known in the art or discovered. Such storage may utilize an embedded microcontroller. In an embodiment, this microcontroller and the LED driver may be on one circuit card contained within the active coupler, however, the storage function may be achieved by any internal computer. In a further embodiment, the computer may simply permit temporary or permanent programming of a coupler with the appropriate information, e.g., signature characteristics and sensitivity levels. Information programmed into a coupler may be retained or deleted upon power-down of the coupler, as desired. In an embodiment, a computer in one coupler may control one or more additional couplers, through a serial cable, through wireless, or by any other means. In an embodiment, an external computer may act as the active coupler's storage, to which the active coupler may be wired or wirelessly connected. Such an external computer may also control more than one active coupler.

The internal or external computer, implementing software, can convert such a stored signal into an actual signal generated by the LED array or laser for the sensor's detection. The computer could also provide the driver with additional signatures, for example, when new missiles are developed. An embodiment of the software allows for creation of new missile signatures, in a freeform manner or to reflect signatures of actual, newly developed missiles. In another embodiment, the software can recall and direct emission of predetermined signatures. Such storage permits customization and infinite expansion of the threat library, for example, to ensure the sensor is tested with missile signatures that a specific aircraft is more likely to encounter. This storage permits the stated goal of creating a signature library for more nuanced and geographically and temporally relevant testing, as well as retrospective evaluation of past tests in the event of a sensor failure.

Figure 2:
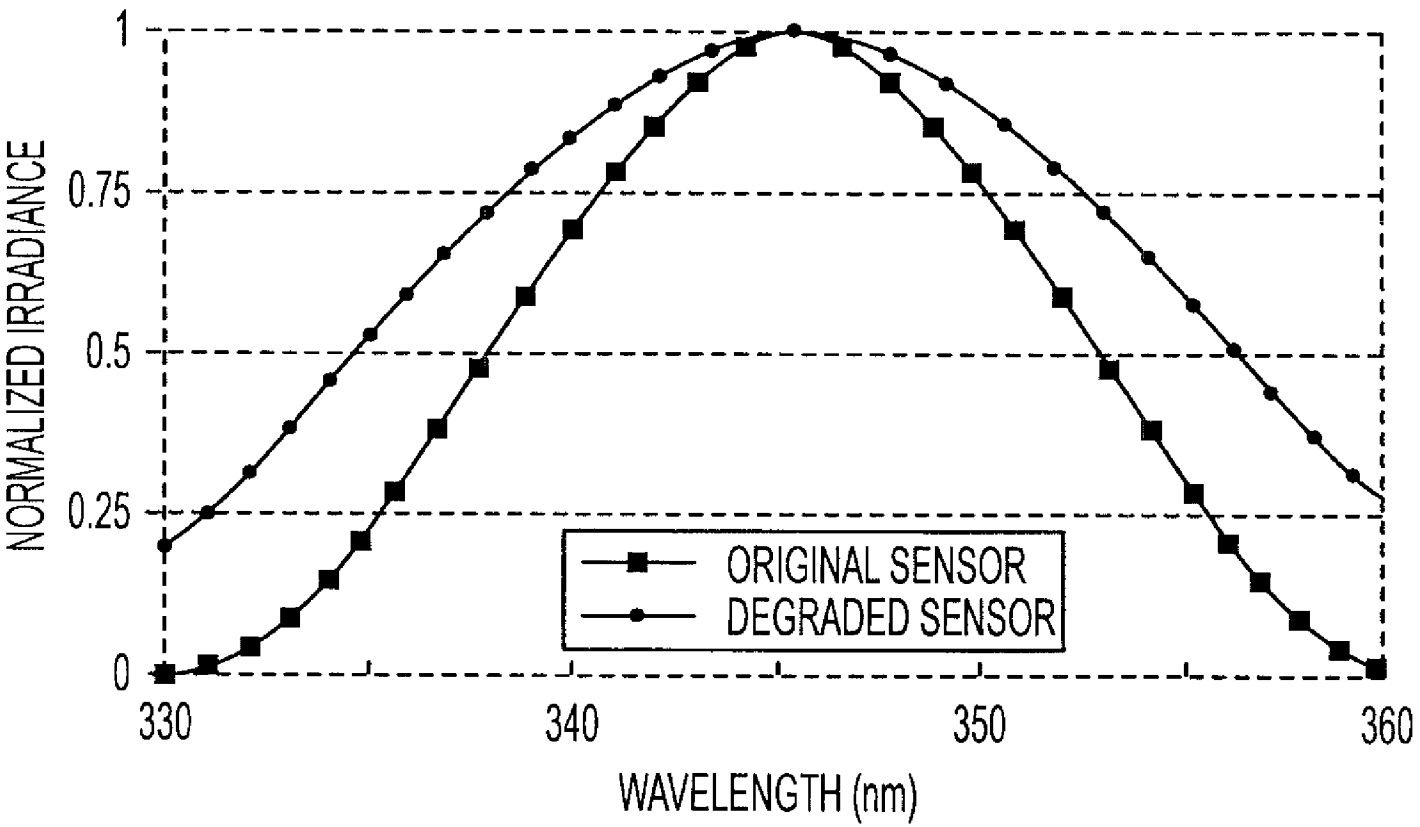
FIG. 2 shows a comparison of a sensitivity test of a degraded sensor compared to a non-degraded sensor.
Figure 3:
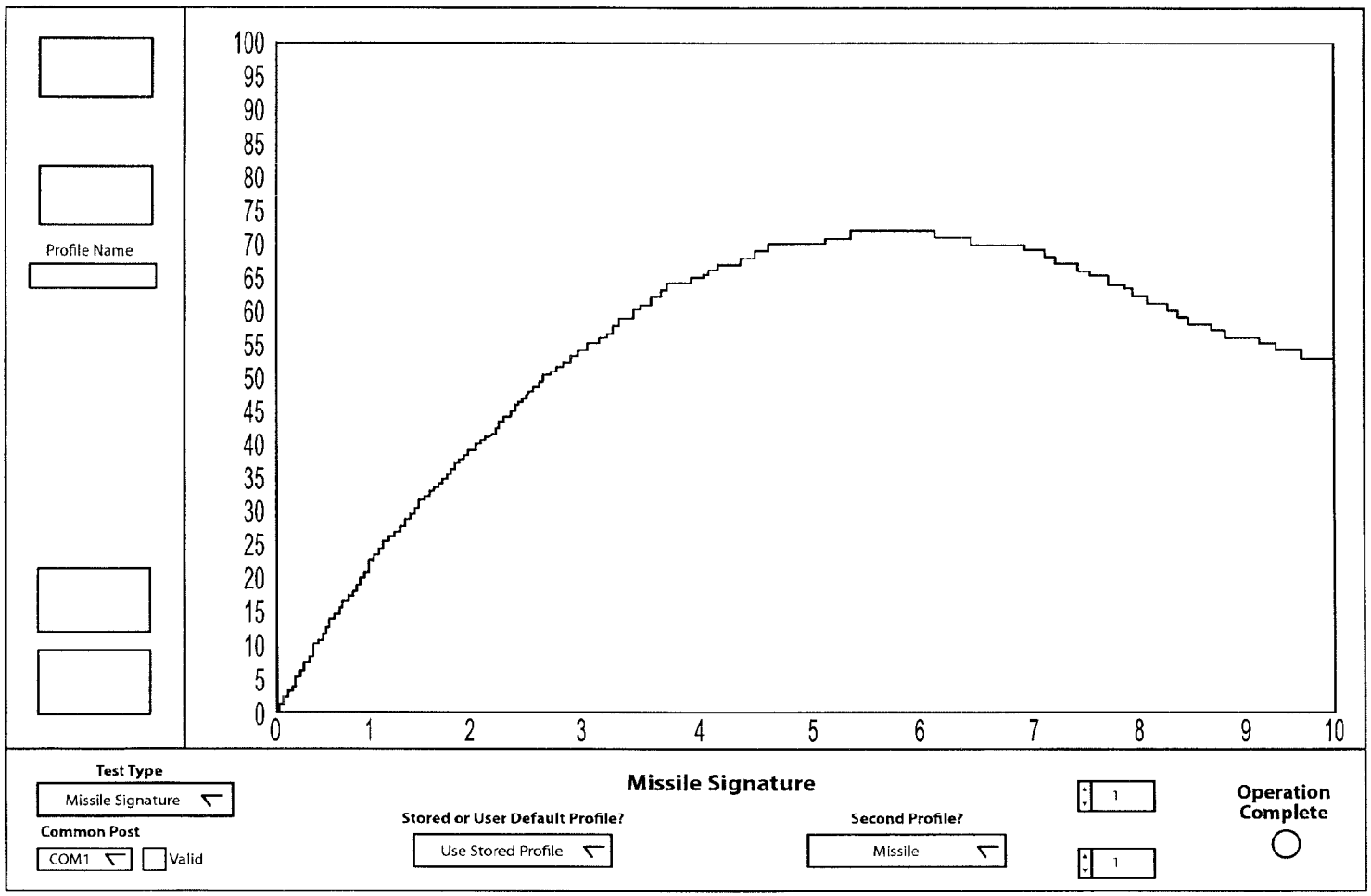
FIG. 3 shows an embodiment of an interface for operator customization of a signature.

In a further embodiment, the computer and software may present an operator with means to choose and customize a stored signal before it is emitted. The operator may choose a signature from the threat library and, for example, change its amplitude, duration, or any other parameter. An embodiment of a computer screen offering such customization is depicted in FIG. 2. Operator input may be through a keyboard, touch screen, or any other means known in the art. The computer and input device may be joined, as in a rugged laptop used in the cockpit, field, or any other location; or separate, as in an electronic clipboard wirelessly connected to the computer.

Test results can also be stored by the active coupler's internal or external computer. They may be recorded and tracked by the optical sensor serial number for each aircraft. Moreover, such storage permits monitoring testing against performance parameters for each aircraft, including aircraft wiring and connector integrity, photodiode relative power, and laser pulse rate interval.

The storage of both simulated signatures and test results can, in alternative or the same embodiments, be permanent or temporary, depending on, among other things, the storage resources and security concerns. If the utilized embodiment of the active coupler does not have the capacity for permanent storage, or if security concerns recommend the deletion of simulated signatures so that other parties cannot detect what signatures were being tested (and thereby perhaps what missile arsenals were being anticipated), the simulated signature can be deleted either manually or automatically upon an event such as turning off the controller.

After the signature is generated and directed at the sensor, the sensor is evaluated for its accuracy in processing that signature. If the signature simulated an actual signature, the sensor's accuracy in identifying the source missile, and the system's appropriateness in response (e.g. jammers, counterfiring, or other defensive measures) may be evaluated. For freeform signatures, the sensor is evaluated for its accuracy in detecting photons over time. Essentially, the sensor is evaluated for whether it can detect the freeform signature and accurately reproduce it, or indicate why it is, or is not, indicative of an actual missile signature.

In an embodiment, the signal is optionally filtered by an internal filter, rather than the external filter of current testers. The filter (not shown) is placed within the coupler's shell (101), to protect it from potentially damaging external environments and the trauma of being removed and stored. The filter may be positioned to interfere with the signal or not, depending on operator preference, by binary operation of an external switch (103) that is operationally connected to the internal filter.

The coupler may also perform sensitivity testing, or calibration. In an embodiment, it does so by changing the intensity of the signal at constant output to verify the tester is meeting sensitivity requirements. In an embodiment, this signal is a fixed-level UVC signal. In an alternative embodiment that tests within the infrared spectrum, an infrared laser may be used. In an embodiment, such a laser would be an 850 nm 5 mW IR laser. In tester embodiments with eight LED channels, this laser would occupy a ninth channel. The laser is modulated using pulse width modulation or any other form of modulation known in the art. In an embodiment using pulse width modulation, the laser may be pulsed at varying duty cycles to test for sensitivity. In one embodiment, five different selections of 0, 25%, 50%, 75%, and 100% are available. In alternate embodiments other pulse width options are available, including a continuously variable pulse width ranging from 0 to 100%. In a further embodiment, the laser would operate with a 100 nanosecond pulse width. In a further embodiment, software run by the associated computer disclosed above may calibrate the sensitivity testing for the ambient temperature, as UV and infrared readings may be inconsistent at different temperatures. In a further embodiment, sensitivity testing may be targeted particularly at wavelengths in which the sensor is prone to degradation. A graph showing sensitivity test results of a degraded and nondegraded sensor is shown in FIG. 2.

The sensor's response to the sensitivity test can then be evaluated for accuracy. This may be performed using a parameter called Photo Irradiance Response ("PIR"), which equals the photon counts per second detected by the sensor divided by the known photon counts per second generated by the tester, or any other useful parameter known in the art. A sensor that has suffered no degradation will detect the same photon counts per second as the tester generated, resulting in a PIR value of 1.0. In an embodiment, the operator may define a threshold acceptable PIR. The PIR value may be displayed in the aircraft cockpit or any other affiliated screen.

In an embodiment, the tester may be used at 0 meters from the sensor to generate continuous counts per second output, which would generate a PIR value of 1.0. This ability to generate and confirm a control value increases the accuracy of the sensitivity testing.

PIR values can also be stored, in any manner disclosed above for the storage of signature testing results (i.e., permanent or temporary, on a device internal or external to the active coupler, in FLASH memory or any equivalent). Sensitivity test results may be recorded and tracked by the optical sensor serial number for each aircraft. Moreover, such storage permits monitoring testing in light of performance parameters for each aircraft, including but not limited to aircraft wiring and connector integrity, photodiode relative power, and laser pulse rate interval.

The active coupler may be used in a variety of ways, including but not limited to having the operator hold it in his/her hand, affixing it to a tripod, or attaching it to the sensor itself. The tripod may be fixed or mobile, as on a vehicle or cart. Each model may be remotely controlled through a computer, connected by wires or wirelessly. Such control may be encrypted, as with 128 AES encryption.

Figure 4B:
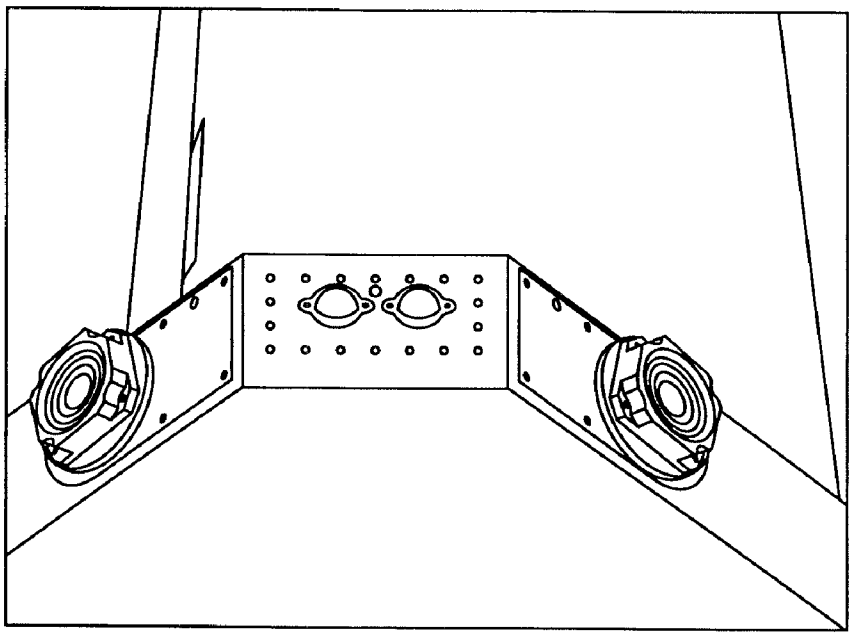
FIG. 4 shows an example of an aircraft sensor.
Figure 4A:
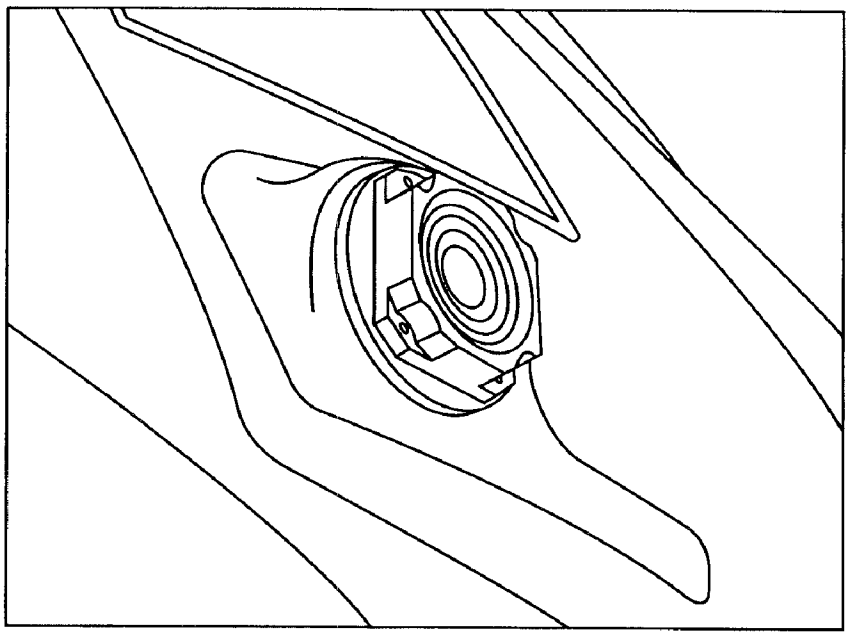
Figure 5:
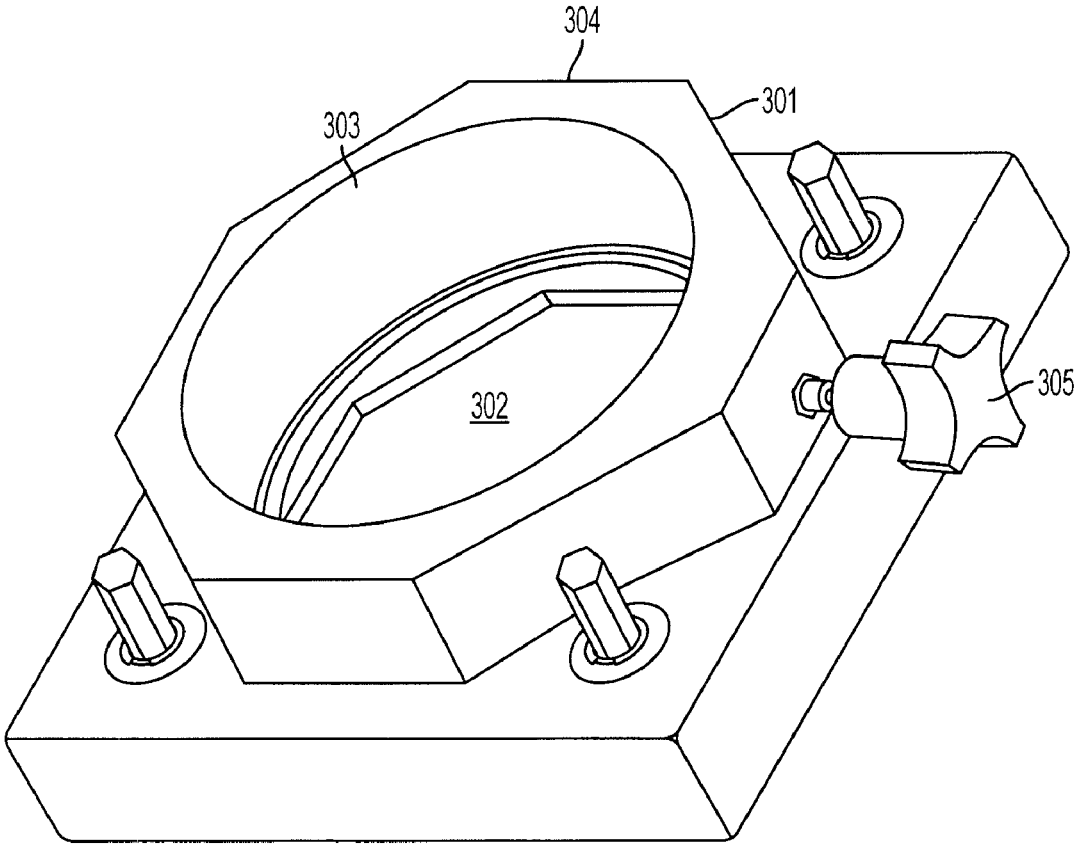
FIG. 5 shows a front-side view of an embodiment of a coupler capable of coupling to a sensor with an octagonal circumference.
Figure 6:
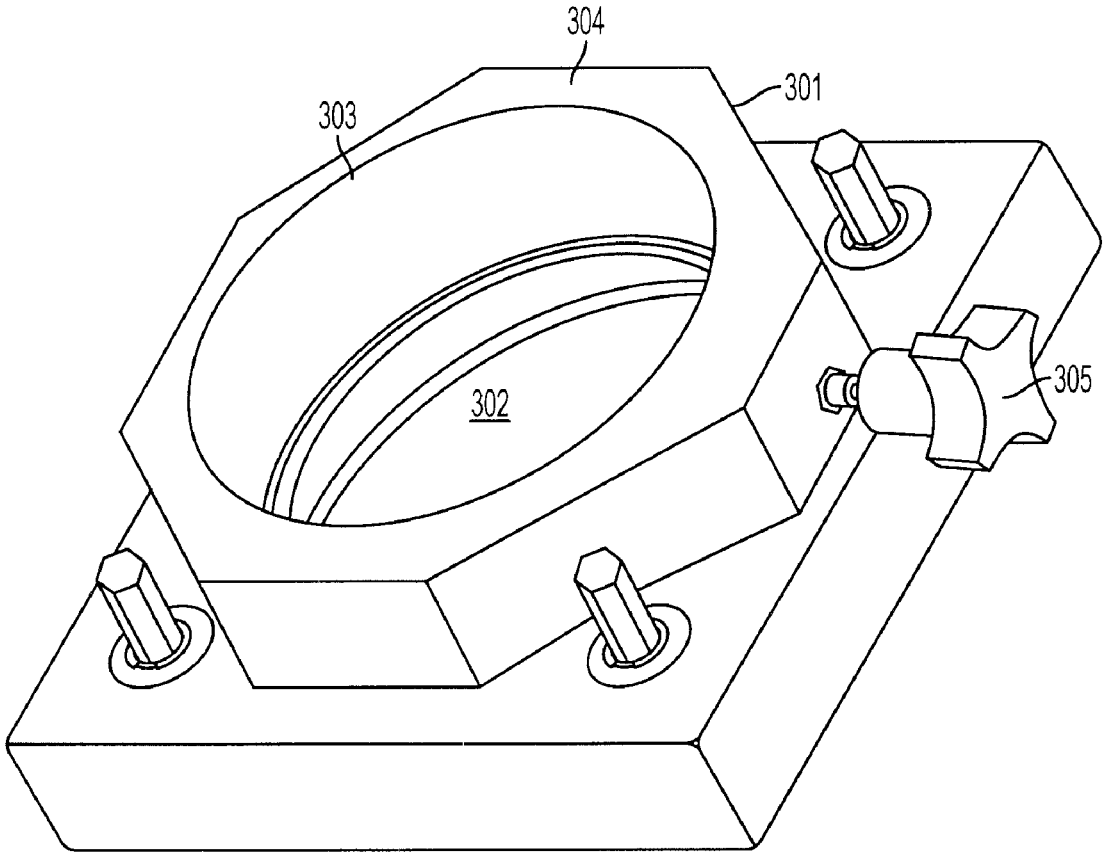
FIG. 6 shows a front-side view of an embodiment of a coupler capable of coupling to a sensor with a round circumference.

The attachment mode of use comprises an adapter (300) that attaches directly to the sensor in a manner that isolates the sensor and tester from any ambient light. Such testing may be referred to as "end to end" testing. Two embodiments of an adapter (300) are shown in FIGS. 5 and 6. The coupler and adapter have a close tolerance interface and are externally opaque, which prevents the introduction of light and provides a controlled testing environment. Such coupler and adapter may be made of any conventional material designed for sturdy attachment. The adapter (300) provides this controlled testing environment by way of cylinder (301) which shields the signal pathway (302) between the coupler interface (150) and the sensor, an example of which is shown in FIG. 4.

The term "cylinder" as used herein draws its name from an embodiment of the shield in which the internal circumference (303) is round, shown in FIGS. 5 and 6; that internal circumference (303) may in fact be any shape, including the same shape as the external circumference (304). External circumference (304) may in turn match the sensor's external circumference, and may take any shape, so long as external circumference (304) and the sensor interact in close interface. Alternative embodiments of the adapter (300), shown in FIGS. 5 and 6, permit mounting to octagonal and round sensors; it is contemplated that an adapter (300) can be fashioned to permit mounting to sensors of any shape and size, known and unknown. Because the adapter (300) is detachable from the coupler (100), different embodiments of the adapter (300) may be used on the same coupler (100) for different aircraft and sensors. This modularity increases the coupler's portability, as only one coupler (100) is needed to test a great number of aircraft.

The adapter (300) also provides for proper positioning in relationship to the aircraft, as well as weight support of the coupler (100). When coupled with the adapter (300), the coupler provides a very accurate method for aligning the coupler (100) to the sensor for consistent signaling, and aligning cylinder (301) for consistent and complete blocking of environmental light. The adapter (300) mounts the coupler (100) to the sensor by compressing a pad (not shown). The pad is placed such that it surrounds the sensor, and is then compressed by compressor (305) to make a snug fit between the adapter (300) and the sensor. The snug fit is achieved by the fact that the pad bulges towards the adapter's (300) center and thus applies pressure around the circumference of the sensor. The pad allows for a soft, nonmarring interface that does not damage either the adapter (300) or the sensor. The pad may be made of any strong and durable but compressible material known in the art that allows for a soft, nonmarring and noncorroding interface, which in an embodiment may be rubber.

The pressure that the adapter (300) exerts on the sensor via the pad, and friction between those components, is sufficiently strong to support the coupler's (100) weight and permit hands-free operation.

Thus, the adapter (300), especially when contained with any remote control mechanism, achieves the stated goal of a technician being able to walk away from the coupler (100) in order to operate it or other couplers (100), or to perform other necessary tasks. It also achieves the stated goal of permitting repeatable and standardized coupling of the coupler (100) to the sensor. The adapter (300) through the pad achieves the same degree of attachment and adherence each time it interfaces with a sensor, which greatly decreases the possibility of human error in manually holding a tester to a sensor.

The adapter (300) by virtue of cylinder (301) and external circumference (304) also consistently aligns the sensor to the coupler (100) within the same lateral area in relationship to the tester, standardizing the amount of environmental light that is blocked from the sensor and again removing the problem of human error in positioning the light-blocking handheld tube of current devices. In current devices, it is believed that sensitivity testing results suffer a rate of variation of approximately thirty percent, due to this human error inherent in the fact that the light-blocking tube is handheld; in the embodiments disclosed herein, such variability is reduced to approximately one percent. Sensitivity and signature testing is thereby standardized among sensors on the same aircraft which are being simultaneously tested, among test occasions of the same sensor, and among sensors on different aircraft. This standardization permits much greater confidence in the sensors' performance across the entire fleet of aircraft and sensors.

Because an actual missile signature is highly scattered by the atmosphere, an actual missile signature stimulates multiple sensors. As such, accurate and useful signature testing should also stimulate multiple sensors. For efficiency's sake, it is desirable for one operator to be able to simultaneously stimulate multiple sensors from one location. If multiple current testers are used, each must be manned by a separate operator, or one operator must move between the multiple testers; one operator cannot simultaneously operate all testers. Another system attempts multiple-sensor stimulation by actually flying the aircraft over a site from which threat rockets are being fired. This is expensive, and requires a proper site to which all testing equipment must be brought. The presence of firing rockets also presents a safety hazard. This form of testing also requires the additional step, after generating an actual signature, of recording the signature's parameters for subsequent use in evaluating the sensor, rather than just using set parameters of a simulated signature. The high cost of producing and gathering signature parameters in this way, from actual rockets, has stymied the important effort to test and standardize missile warners.

It is therefore desirable to have testers that can be used in multiplicity and simultaneously without requiring more than one operator. It is also desirable to have multiple testers, synchronized via wire or wireless connections to a controller, to provide a portable controlled test environment for multiple sensors. It is also, and relatedly, desirable for one operator to be able to synchronize and control multiple testers from one location such as the tested aircraft's cockpit.

Addressing these needs and others, the coupler (100) may be used singly or in tandem with one or more other couplers (100). Multiple couplers (100) can be set up to create a "surround sound" simultaneous simulation that the plane or other target bearing sensors receives. The couplers (100) can be mounted to some or all of the aircraft's sensors, or can be mounted on fixed or mobile tripods surrounding the aircraft.

These couplers (100) may be connected by wires or wirelessly, with context-appropriate encryption. In a further embodiment, the connection permits a central control unit such as a laptop or computer within the aircraft cockpit to direct all connected couplers (100). In a further embodiment, the connected couplers (100) may take direction from each other, for example by detecting whether or not a connected coupler (100) has signaled and at what parameters, and adjusting its own signal accordingly. Thus, one operator may control intelligent multi-coupler signal generation from a central location.

The laptop or computer would read software providing testing parameters. Such parameters may include absolute signal timing, signal timing relative to other couplers, absolute and relative coupler location, strength of emission, the amplitude and length of the signal, the wavelength, emitter bulbs used, and any other type of information desired in generating and emitting a signal. It may also direct selective use of multiple channels for more complex testing. The laptop or control unit may thus be used to simulate the multi-sensor receipt of data that would occur if a missile were actually fired at an aircraft. The connected couplers (100) may also emit signals synchronized to simulate multiple missiles having been fired, or any other goal.

In a further embodiment, the software automates the entire testing process. Such automation may include choosing a signature from the library, choosing more concrete criteria such as coupler placement and signal parameters, and storing the emitted signature and test results.

The software, central control computer, and the connection between couplers (100) achieves the goal of having multiple couplers (100) signal multiple sensors in a portable and cost-effective manner. It also achieves the goal of having multiple testers controllable by a single operator, such that multiple testers need not be manned or controlled by multiple operators.

In another embodiment, each quadrant of the active coupler would be outfitted with a pre-programmed, more cursory and standardized "GO/NO-GO" testing function. This function would be initiated independently at each quadrant in order to provide a pre-flight sensor check using a simulated signature. In an embodiment, this signature could simulate an actual missile from the arsenal that the departing aircraft might be about to face on that flight. In an embodiment, a tester equipped for GO/NO-GO testing may be handheld by an operator walking around the aircraft, such that the sensor may be tested as the aircraft prepares for takeoff, without interfering with other pre-flight procedures. In another embodiment, a GO/NO-GO signature tester may be mounted along the takeoff path.

The embodiments disclosed herein may be used in the following manner (or any other). An aircraft with missile sensors is prepared for a mission. Couplers are affixed, by the adapter and pad, to each sensor on the aircraft. A user in the cockpit selects a signature, previously and securely loaded into a computer, that simulates the plume of a missile the aircraft may actually encounter in its mission. By way of the computer, the user directs all couplers to emit the signature by way of one or more LED bulbs. The couplers do so simultaneously, providing signals in the form of relatively complex waveforms to the sensor(s) in a manner that stimulates particular quadrants of the sensors. The signal also includes wavelengths in the sensor(s)' degradation band edge. The user in the cockpit can assess the sensor(s)' response to the signals for accuracy (i.e., did the sensor accurately identify the missile that emits the simulated plume), adequacy (i.e., did the sensor direct the proper defensive mechanisms for that missile), and cooperation (i.e., did the sensors coordinate correctly). The test may be repeated with sequential presentation of different signatures to encompass the entire arsenal the aircraft may encounter. The results of all of these tests may be stored for future reference in a manner that links them to the particular aircraft. On a different mission, the computer may be loaded with different signatures simulating a different arsenal. If that user or the pilot (who may be the user) is satisfied with the adequacy and accuracy of the sensor's response, the user may then test the sensors for sensitivity, wherein the test is calibrated for environmental conditions. Via the computer, the user would direct the coupler to emit a signal that changes in intensity. If the sensor detects a signal with intensity below a certain threshold, the sensor "passes" the sensitivity test. Upon passing the signature identification and sensitivity tests, the aircraft is cleared to embark on its mission.

Alternatively, the prepared aircraft may be on the runway about to take off. A user selects a signature, previously loaded into a rugged laptop computer, that simulates the plume of a missile the aircraft may actually encounter. The user causes a handheld coupler equipped with a trigger mechanism (either on the coupler itself or on the computer) to emit the signature by way of one or more LED bulbs, pointing the handheld coupler at a sensor. If that user or the pilot (who may be the user) is satisfied with the adequacy and accuracy of the sensor's response, the user may then test the sensors for sensitivity, wherein the test is calibrated for environmental conditions. Via the computer, the user would direct the coupler to emit a signal that changes in intensity. If the sensor detects a signal with intensity below a certain threshold, the sensor "passes" the sensitivity test. Upon passing the signature identification and sensitivity tests, the aircraft may take off.

While the invention is disclosed in conjunction with a description of certain embodiments, including those that are currently the preferred embodiments, the detailed description is intended to be illustrative and should not be understood to limit the scope of the present disclosure. As would be understood by one of ordinary skill in the art, embodiments other than those described in detail herein are encompassed by the present invention. Modifications and variations of the described embodiments may be made without departing from the spirit and scope of the invention.

The invention claimed is:

1. A system for testing a missile warning system, comprising:

a coupler comprising a signal generator, a light emitter, an internal filter, and an external switch for said filter, said coupler being directly or indirectly frictionally secured to and optically aligned with a sensor being tested, the light emitter including a plurality of light emitters, wherein at least two of the plurality of light emitters are oriented at different angles to enable simulation of different angles of approach;

digital storage functionally linked to said signal generator, wherein said digital storage stores information including a plurality of signatures; and a computer capable of permitting a user to select a signature from said plurality;

wherein said signal generator generates said selected signature and causes it to be emitted by said light emitter.

2. The system of claim 1 wherein said light emitter is an LED bulb in the infrared spectrum.

3. The system of claim 1 wherein said light emitter is an LED bulb in the ultraviolet spectrum.

4. The system of claim 1 wherein said digital storage is FLASH memory.

5. The system of claim 1 wherein said digital storage is internal to said coupler.

6. The system of claim 1 wherein said digital storage is on an external computer.

7. The system of claim 1 wherein said information comprises results of a test of a sensor by said coupler.

8. The system of claim 1 wherein said information comprises results of a test, said results identified by sensor or by aircraft.

9. The system of claim 1 wherein said selected signature is derived from freeform.

10. The system of claim 1 further comprising an adapter, comprising:

a cylinder designed to interface with an aircraft sensor to be tested, a pad, and a compressor;

wherein said adapter affixes said coupler to said sensor when said cylinder surroundingly interfaces with said sensor and when said pad is compressed.

11. The system of claim 1 wherein said coupler is handheld.

12. The system of claim 1 wherein said signature is converted to a linear analog current drive for emission.

13. The system of claim 1 wherein said missile warning system comprises quadrants, and wherein said signature emitted by said light emitter stimulates more than one of said quadrants.

14. The system according to claim 1, wherein the plurality of light emitters have multiple channels and are paired off to four quadrants, wherein each pair being oriented at different angles, such that the channels permit simulation of different angles of approach.

15. The system according to claim 14, wherein each of the channels of light emitters include a plurality of different spectrum light emitters, thereby enabling simultaneous testing of each of the quadrants with multiple wavelengths of light.

16. A system for testing a multisensor missile warning system, comprising:

a first coupler comprising a first signal generator and a first light emitter;

a second coupler comprising a second signal generator and a second light emitter;

digital storage functionally linked to said first signal generator and said second signal generator, wherein said digital storage stores information including a plurality of signatures; and a computer, wherein said computer is capable of permitting a user to select a first signature from said plurality of signatures, and of directing said first signal generator to generate said first signature and cause said first light emitter to emit said first signature, and of directing said second signal generator to generate said first signature and cause said second light emitter to emit said first signature, the first and second signal generators simultaneously generating the first signature so as to provide for the multisensor missile warning system to be tested using a surround sound simultaneous simulation for testing the multisensor missile warning system using the first coupler and the second coupler;

wherein said first coupler and said second coupler are in digital communication with said computer and configured to be directly or indirectly frictionally secured to and optically aligned with a first sensor and a second sensor, respectively, being tested;

wherein said first signal generator generates said selected first signature and causes said first signature to be emitted by said first light emitter onto said first sensor; and wherein said second signal generator generates said first signature and causes said first signature to be emitted by said second light emitter onto said second sensor.

17. The system of claim 16 wherein said computer is a component of said first coupler.

18. The system of claim 16 wherein said signature is converted to a linear analog current drive for emission.

19. The system of claim 16 wherein said emission by said first light emitter and said emission by said second light emitter are simultaneous.

20. The system of claim 16 wherein said first coupler is affixed to said first sensor by a first adapter, and said second coupler is affixed to said second sensor by a second adapter;

wherein said first adapter and said second adapter each comprise a cylinder designed to interface with said first sensor or said second sensor, respectively, a pad, and a compressor;

wherein said first adapter affixes said first coupler to said first sensor when said cylinder surroundingly interfaces with said first sensor and when said pad is compressed; and wherein said second adapter affixes said second coupler to said second sensor when said cylinder surroundingly interfaces with said second sensor and when said pad is compressed.

21. The system of claim 16 wherein said first coupler and said second coupler are handheld.

22. The system according to claim 16, wherein said first and second signatures are identical.

23. The system according to claim 16, wherein the first and second light emitters are each configured with a plurality of light emitters that have multiple channels.

24. The system according to claim 23, wherein the different channels provide for different quadrants of an optical receiver to be illuminated.

25. The system according to claim 23, wherein each of the different channels include a plurality of different spectrum light emitters, thereby enabling simultaneous testing of each of the quadrants with multiple wavelengths of light.

26. The system according to claim 16, wherein said first and second couplers are configured to communicate with one another, said second coupler receiving one or more parameters and operations from said first coupler and, in response, adjusting one or more parameters and operations being generated by said second coupler.

27. A method for testing a missile warning system, comprising:

having a sensor for light in the spectrum of a missile plume;

providing a coupler comprising a signal generator and a light emitter;

frictionally securing the coupler to and optically aligning the coupler with the sensor being tested;

providing digital storage functionally linked to said signal generator, wherein said digital storage stores information including a plurality of signatures;

selecting a signature from said plurality using a computer;

generating said signature from said signal generator;

emitting said signature from said light emitter, the light emitter including a plurality of light emitters, wherein at least two of the plurality of light emitters are oriented at different angles to enable simulation of different angles of approach;

analyzing a response of said sensor to said signature;

storing said response in said digital storage;

generating a report including the response of said sensor to said signature; and displaying the report including the response of said sensor to said signature for a user.

28. The method of claim 27 further comprising a step of converting said signature to a linear analog current drive for emission.

29. The method of claim 27 further comprising a step of affixing said coupler to said missile warning system by an adapter.

30. The method of claim 27 wherein said missile warning system comprises quadrants, and wherein said step of emitting stimulates more than one of said quadrants.

31. The method of claim 27 wherein said information comprises results of a test of a sensor by said coupler.

32. The method of claim 27 wherein said sensor is a first sensor, and wherein said step of having further comprises having a second sensor;

wherein said coupler is a first coupler;

further comprising a step of providing a second coupler in digital communication with said first coupler; and wherein said steps of generating and emitting are performed by both said first coupler and said second coupler.

33. The method of claim 32 further comprising a step of affixing said first coupler to a first sensor by a first adapter, and said second coupler to a second sensor by a second adapter.

34. The system according to claim 27, further comprising:

a second coupler including a second signal generator and second light emitter; and the computer being in communication with said first and second couplers, the computer being configured to cause said first and second couplers to generate signals having the signature and to illuminate the sensor and a second sensor with the signals.

35. The system according to claim 27, wherein the plurality of light emitters have multiple channels and are paired off to four quadrants, wherein each pair is oriented at the angle, such that the channels permit simulation of different angles of approach.

36. The system according to claim 35, wherein each of the channels of light emitters include a plurality of different spectrum light emitters, thereby enabling simultaneous testing of each of the quadrants with multiple wavelengths of light.

* * * * *